US009371690B2

(12) United States Patent
Wolek

(10) Patent No.: US 9,371,690 B2
(45) Date of Patent: Jun. 21, 2016

(54) MECHANISM FOR CONTROLLING THE ROTATION OF A ROLLER BLIND WINDING ROLLER HAVING A SPRING DRIVE

(71) Applicant: Jerzy Wolek, Swidnica (PL)

(72) Inventor: Jerzy Wolek, Swidnica (PL)

( * ) Notice: Subject to any disclaimer, the term of this patent is extended or adjusted under 35 U.S.C. 154(b) by 250 days.

(21) Appl. No.: 14/093,941

(22) Filed: Dec. 2, 2013

(65) Prior Publication Data

US 2014/0103157 A1 Apr. 17, 2014

Related U.S. Application Data

(63) Continuation-in-part of application No. 13/456,952, filed on Apr. 26, 2012, now abandoned, which is a continuation of application No. PCT/PL2010/000114, filed on Nov. 8, 2010.

(30) Foreign Application Priority Data

Mar. 7, 2010 (PL) ..... P390633

(51) Int. Cl.
*E06B 9/60* (2006.01)
*E06B 9/80* (2006.01)

(52) U.S. Cl.
CPC ... *E06B 9/60* (2013.01); *E06B 9/80* (2013.01); *E06B 2009/807* (2013.01); *E06B 2009/808* (2013.01)

(58) Field of Classification Search
CPC ..... E06B 9/80; E06B 9/82; E06B 9/60; E06B 9/42; E06B 2009/807; E06B 2009/808
See application file for complete search history.

(56) References Cited

U.S. PATENT DOCUMENTS

| | | | | |
|---|---|---|---|---|
| 4,188,992 A * | 2/1980 | Segerljung | ..... | E06B 9/82 160/296 |
| 4,513,805 A * | 4/1985 | Mase | ..... | E06B 9/80 160/299 |
| 2005/0035238 A1* | 2/2005 | Fun | ..... | E06B 9/72 242/381 |

* cited by examiner

*Primary Examiner* — Luis A Gonzalez
(74) *Attorney, Agent, or Firm* — Norton R. Townsley; Belasco Jacobs & Townsley, LLP

(57) ABSTRACT

One embodiment of a mechanism for controlling the rotation of a roller blind winding roller having a spring drive and immovably fixed to a roller blind holder and its winding roller is constructed of an inner shaft (1), on which a sleeve (2) is rotationally seated. In the sleeve (2) there is rotationally seated an inner roller (4), and between the sleeve (2) and the inner roller (4) there is an annular slot (5) filled with a braking layer (26) formed from high viscosity medium. The inner roller (4) contains a formed driver (6) and in the sleeve (2), between the inner roller (4) and the inner shaft (1) there is a brake shoe (3) seated with its pin (9) in the opening (7) of the inner shaft (1), and a relief (8) where the driver (6) of the inner roller (4) is seated.

3 Claims, 19 Drawing Sheets

MECHANISM FOR CONTROLLING THE ROTATION OF A ROLLER BLIND WINDING ROLLER HAVING A SPRING DRIVE

CROSS REFERENCE TO RELATED APPLICATIONS

This application is a Continuation-in-Part of U.S. patent application Ser. No. 13/456,952, filed 26 Apr. 2012, which is a continuation of PCT Application No. PCT/PL2010/000114, filed 8 Nov. 2010 which claims priority from Polish National Application No. P-390633, filed 7 Mar. 2010. The entire, specification, claims and drawings of U.S. patent application Ser. No. 13/456,952 and PCT Application No. PCT/PL2010/000114 are hereby incorporated herein by reference.

BACKGROUND OF THE INVENTION (1) Field of the Invention

The present invention relates to the field of window shades or roller blinds. The subject of invention is a mechanism controlling the rotation of roller blinds winding roller with a spring drive, especially window blinds, when rolling or unrolling the sunshade.

(2) Description of the Related Art

There are known restraining devices containing a decelerating structure, connected with roller blinds having spring drive. These are generally described as toothed planetary gear units with a central wheel, planet wheels and ring gear. A rotor is joined with the central wheel and planet wheels are rotationally seated on a unidirectional coupling, while the ring gear is rotationally joined with a roller, hollowed along its entire length, the two ends of which are rotationally joined with a couple of bearing pivots. The edge of the sunshade is attached to the roller, and inside the roller there is an immobile middle rod, joined to one of the bearing pivots. A spring, functionally adjusted to impart rotation of the roller in a first direction round its axis with pull on the sunshade, is joined with the middle rod and with the roller. In the roller there is located a fluid brake, functionally connected with the roller and middle rod, restraining rotation of the roller in its first direction. A chamber of the liquid brake is rotationally joined with the roller.

The problem with these known restraining devices is that their endurance is low.

U.S. Pat. No. 4,513,805 to Mase discloses a mechanism for controlling rotation of a roller blind comprising a fixed shaft 2, a stator 4, a rotator 7, a center shaft 8, a rotary shaft 17, a tube 1, a ring gear 13, a brake drum 18, a gearing cover 14, brake shoes 23, absorbing rubber 25, arcuate weights 22, axes 11, planet gear 12, sun gear 16, arm 19, and pins 21.

The Mase solution is based on completely different principles of operation and construction than the instant invention. In the Mase solution the speed of the roller shade is increase through the planetary gear and the increased speed is transmitted to the holder, on which are mounted oscillating weights. Under the influence of centrifugal force the weights diverge outwardly and press on the braking surfaces of the sleeve. The higher the roller shade speed, the greater the braking force.

Development of a restraining device with higher endurance represents a great improvement in the field of roller binds and satisfies a long felt need of the roller blind customers.

SUMMARY OF THE INVENTION

The present invention is a mechanism for controlling the rotation of a roller blind winding roller with a spring drive, immovably fixed to a roller blind holder. The winding roller is made of a pipe inside which an inner roller is seated on which a sleeve is seated. In the sleeve there is an inner roller seated rotationally, and between the roller and the sleeve there is an annular slot filled with a braking layer formed of high viscosity medium. The inner roller contains a driver and in the sleeve, between the inner roller and inner shaft there is a brake shoe seated with its pin in the inner shaft's opening and a relief where the inner roller's driver is seated.

Alternatively, the inner shaft has a pin, the brake shoe has an opening, and the inner shaft's pin is seated in the opening of the brake shoe.

The second example of performance of this invention is an inner shaft on which a sleeve is rotationally seated. An inner roller is seated rotationally in the sleeve, and between the inner roller and the sleeve there is an annular slot filled with a braking layer formed from high viscosity medium. The inner roller contains a formed driver and in the sleeve, between the inner roller and outer shaft there is a brake shoe seated with a pin in the inner shaft's opening, and has a driver which co-operates with the inner roller's driver.

Alternatively, the inner shaft has a pin, the brake shoe has an opening, and the inner shaft's pin is seated in the opening of the brake shoe.

The third example of performance of this invention is an inner shaft on which a sleeve is rotationally seated. An inner roller is seated rotationally in the sleeve. Between the inner roller and the sleeve there is an annular slot filled with a braking layer formed from high viscosity medium. The inner roller contains a formed relief and in the sleeve, between the inner roller and outer shaft there is a brake shoe seated with a pin in the inner shaft's opening, and a driver which co-operates with the inner roller's relief.

Alternatively, the inner shaft has a pin, the brake shoe has an opening, and the inner shaft's pin is seated in the opening of the brake shoe.

The fourth example of performance of this invention is an inner shaft on which a sleeve is rotationally seated. In the sleeve there is rotationally seated an inner roller, and between the inner roller and the sleeve there is an annular slot filled with a braking layer formed from high viscosity medium. The inner roller contains a pin and in the sleeve, between the inner roller and inner shaft there is a brake shoe with a pin seated in the inner shaft's opening, and a brake shoe has an opening in which the inner roller's pin is inserted.

Alternatively, the inner shaft has a pin, the brake shoe has an opening, and the inner shaft's pin is seated in the opening of the brake shoe.

The fifth example of performance of this invention is an inner shaft on which a sleeve is rotationally seated. In the sleeve there is rotationally seated an inner roller, and between the sleeve and the inner roller there is an annular slot filled with a braking layer formed from high viscosity medium. The inner roller contains an opening and in the sleeve, between the inner roller and the inner shaft there is a brake shoe seated with its pin in the inner shaft's opening, and having a pin which co-operates with the inner roller's opening.

Alternatively, the inner shaft has a pin, the brake shoe has an opening, and the inner shaft's pin is seated in the opening of the brake shoe.

The solution applied in this invention ensures several times higher endurance of the mechanism in comparison to known designs.

The remaining aims and objectives of this invention and the rule of its operation have been presented on the drawings with the detailed description of a preferred embodiment.

DETAILED DESCRIPTION OF THE PREFERRED EMBODIMENT

Figure 1:
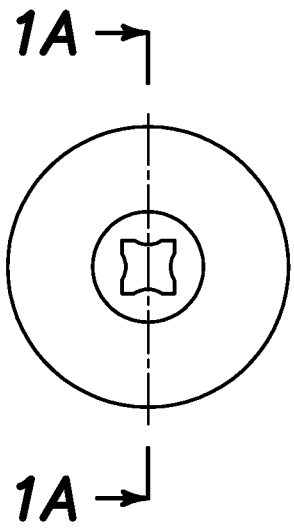
FIG. 1 is a view from one end of this invention.
Figure 1B:
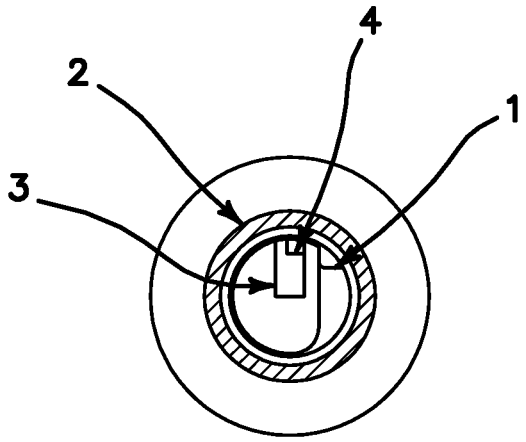
FIG. 1B is a cross section along the lines 1B-1B of FIG. 1A; in other words a lateral cross section of the invention.
Figure 1A:
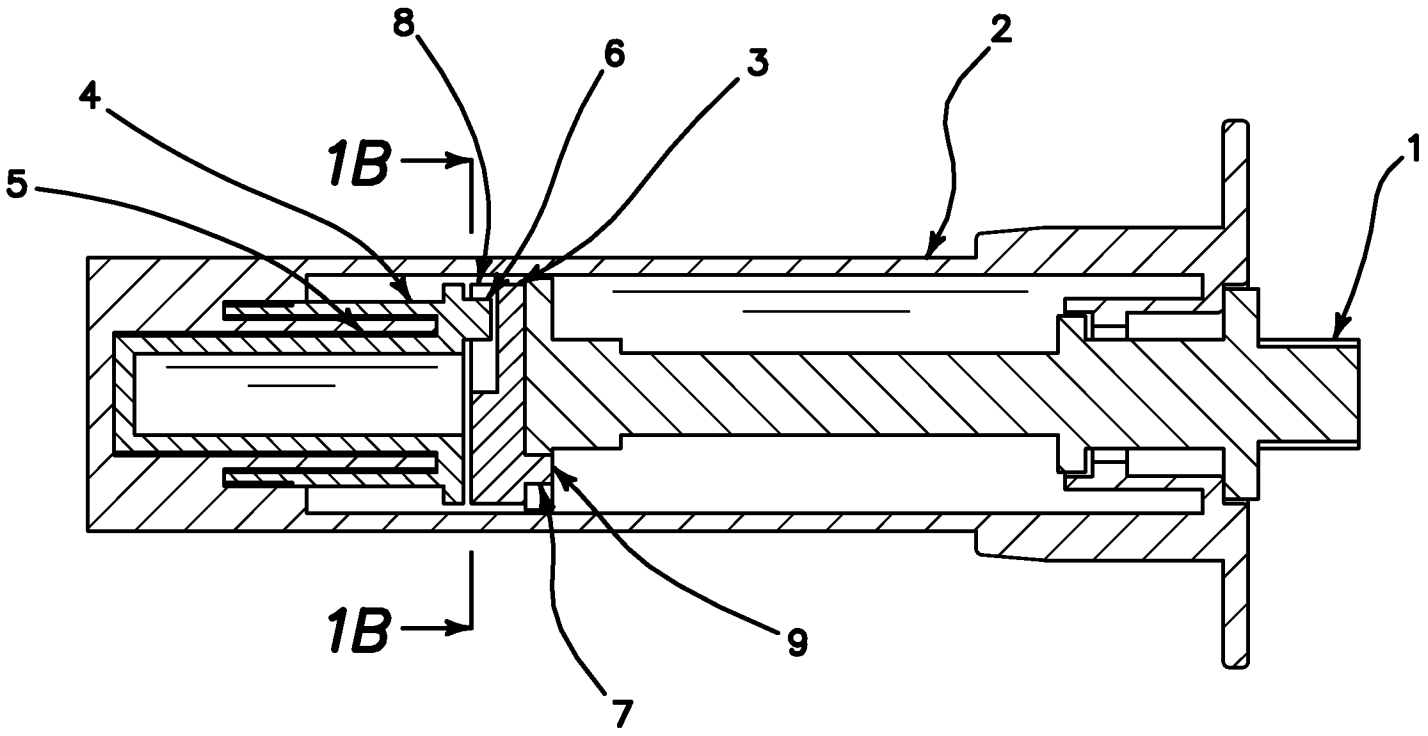
FIG. 1A is a cross section along the lines 1A-1A (in other words a longitudinal cross section) of FIG. 1 showing a first embodiment of this invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

As shown in FIGS. 1, 1A, 1B and 1E, a first embodiment of this invention is made up of an inner shaft 1, on which a sleeve 2 is rotationally seated. In the sleeve 2 there is rotationally seated an inner roller 4, and between the sleeve 2 and the roller 4 there is an annular slot 5 filled with a braking layer 26 made from a high viscosity medium. The inner roller 4 includes a formed driver 6. Between the inner roller 4 and inner shaft 1 there is a brake shoe 3 seated with its pin 9 in the opening 7 of the inner shaft 1. The brake shoe 3 has a relief 8 in which the driver 6 of the inner roller 4 is seated.

Figure 1C:
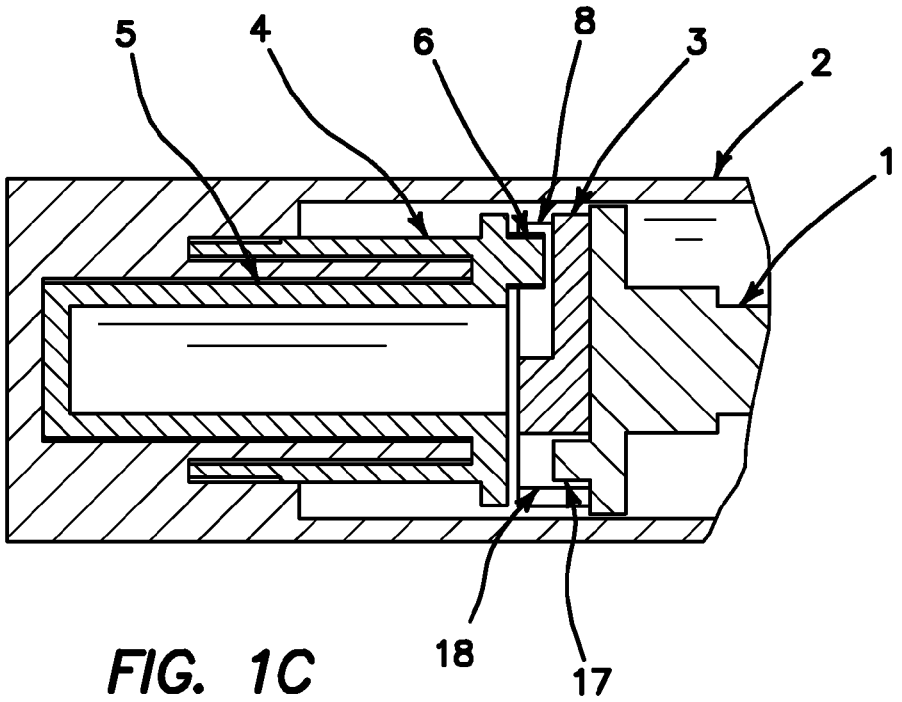
FIG. 1C is a partial cross section showing a first variation applicable to all embodiments of this invention.
Figure 1D:
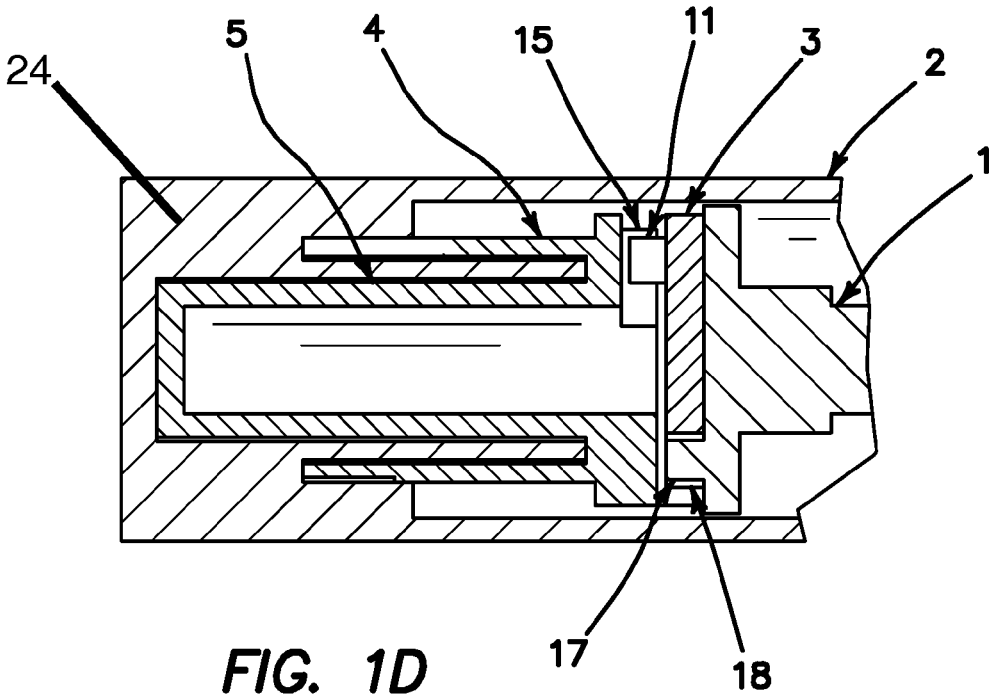
FIG. 1D is a partial cross section showing a second variation applicable to all embodiments of this invention.
Figure 1E:
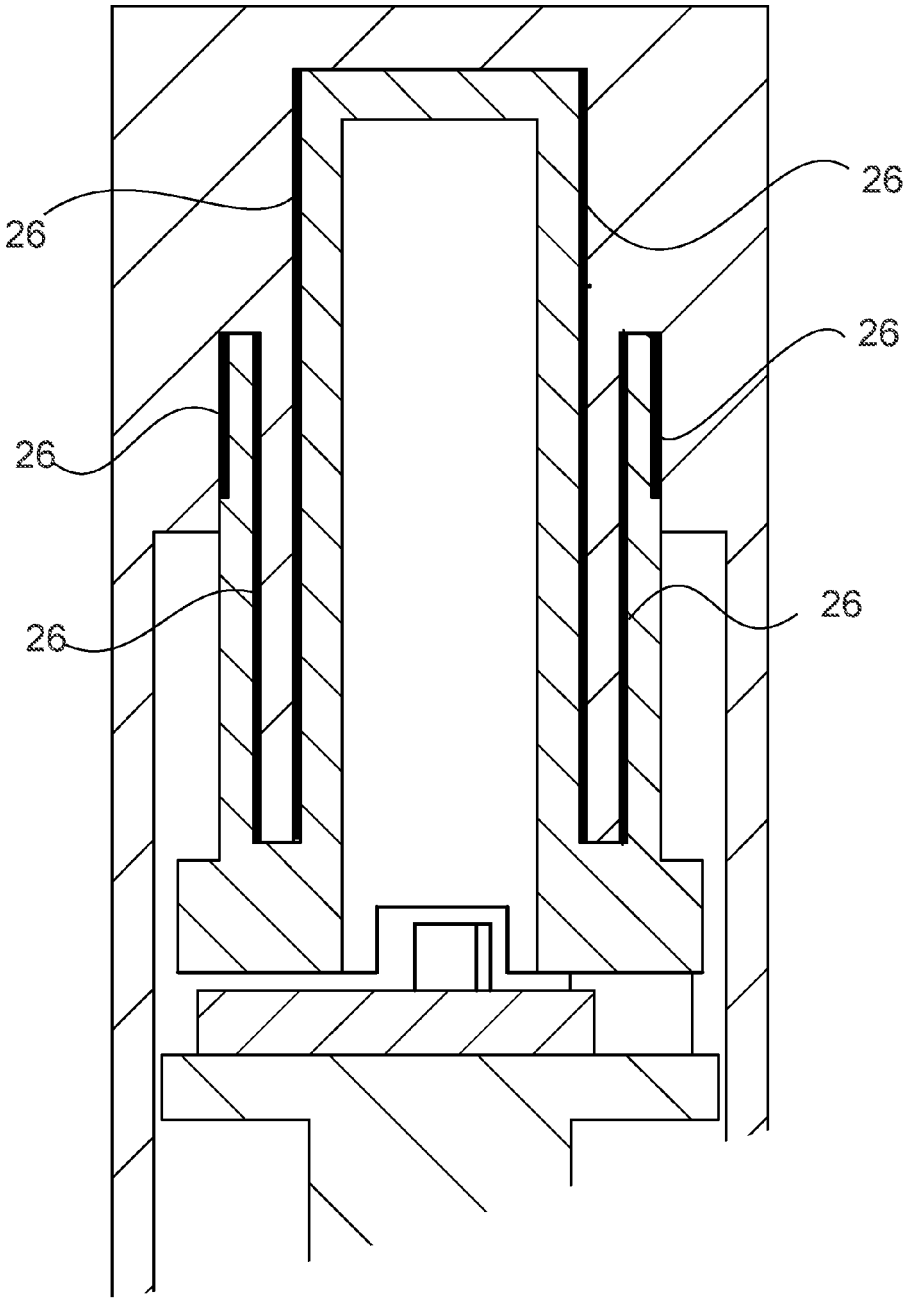
FIG. 1E is an enlarged, partial cross section of FIG. 1D.
Figure 2A:
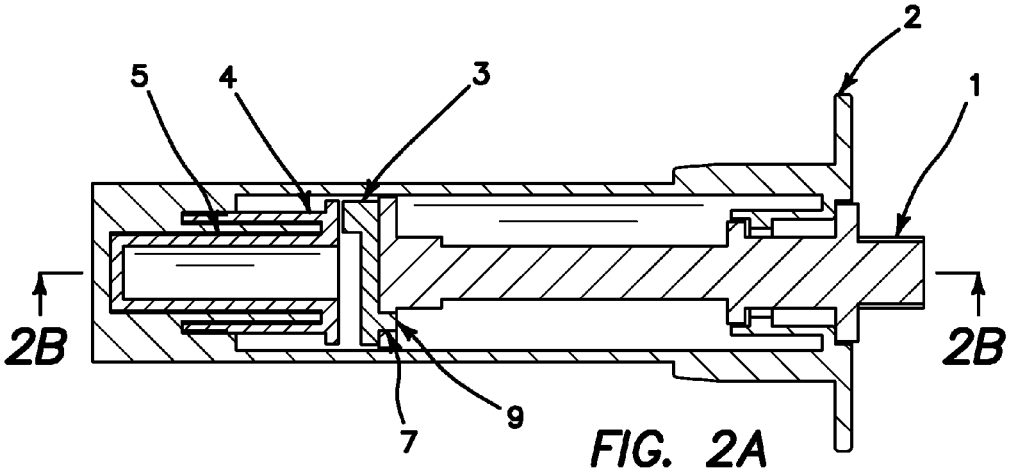
FIG. 2A is a cross section along the lines 1A-1A of FIG. (in other words a longitudinal cross section) 1 showing a second embodiment of this invention.
Figure 2B:
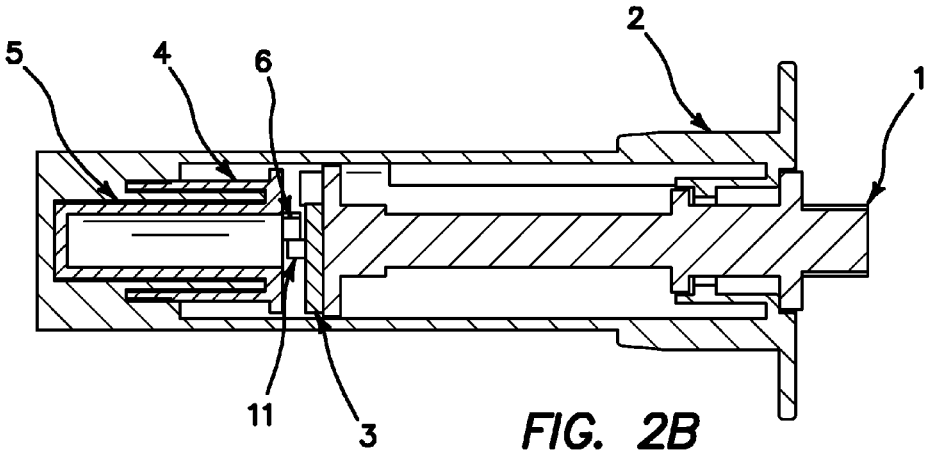
FIG. 2B is a cross section along the lines 2B-2B of FIG. 2A; in other words a longitudinal cross section at 90 degrees from the plane of cross section shown in FIG. 2A.
Figure 2C:
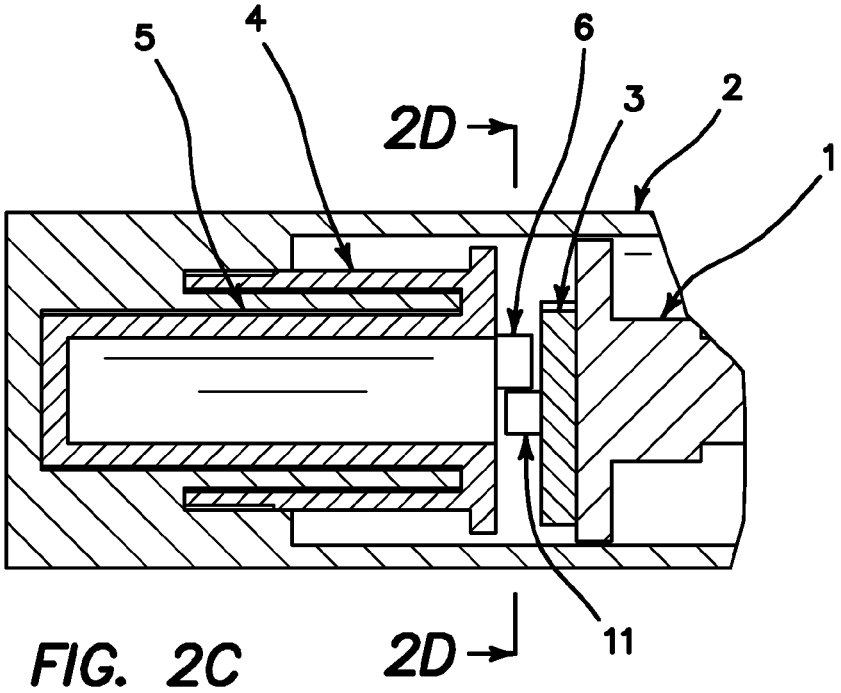
FIG. 2C is an enlarged, partial view of FIG. 2B.
Figure 2D:
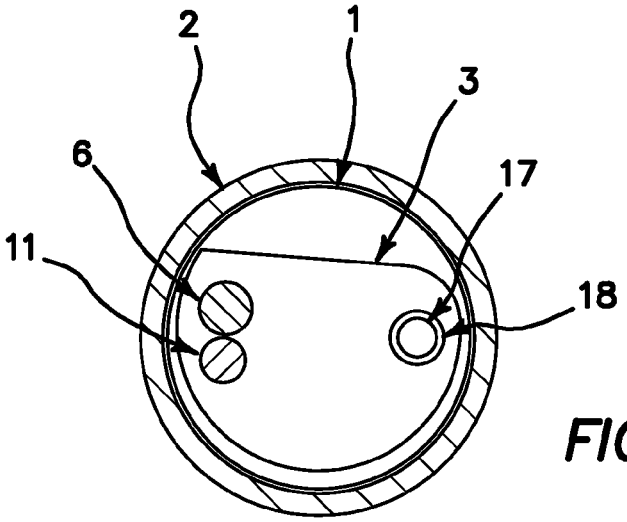
FIG. 2D is a cross section along the lines 2D-2D of FIG. 2C; in other words a lateral cross section of the invention.
Figure 2E:
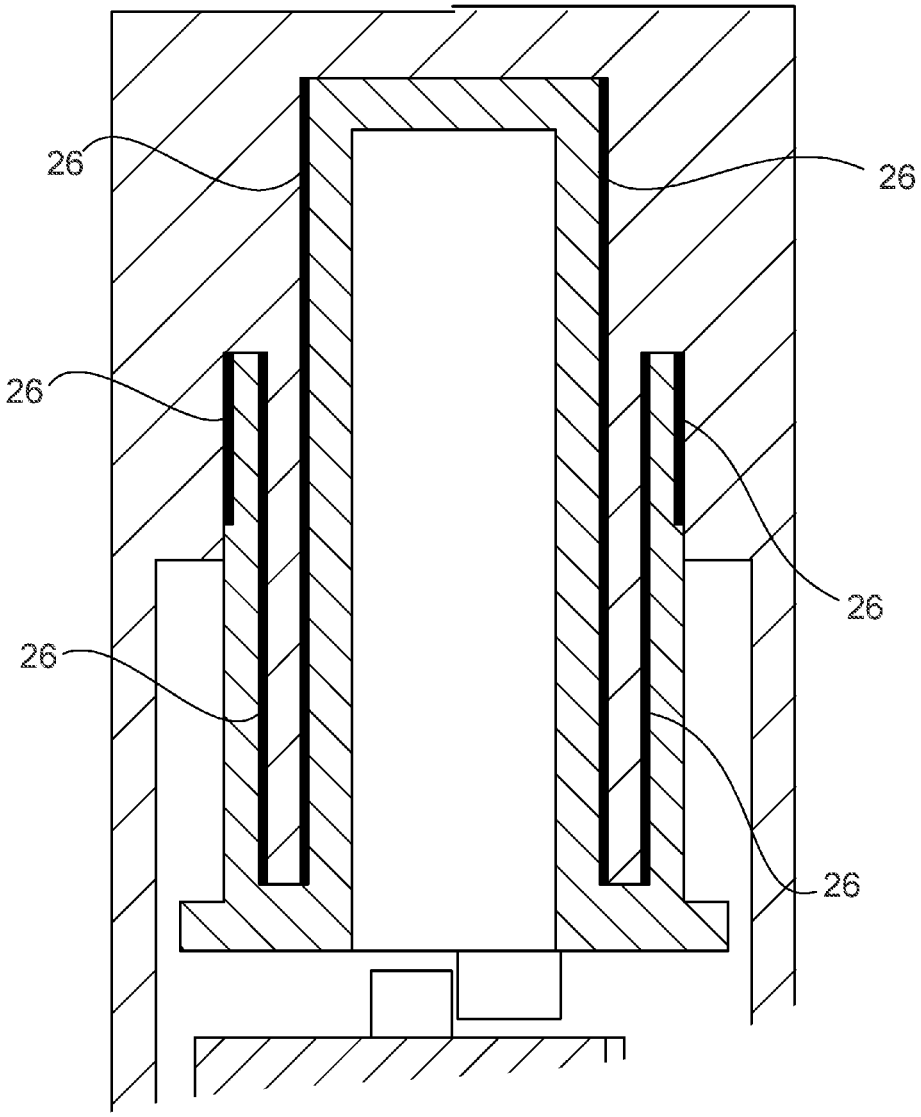
FIG. 2E is an enlarged, partial cross section of FIG. 2D.

Alternatively, as shown in FIGS. 1C, the inner shaft 1 has no opening 7 but has a pin 17, the brake shoe 3 has no pin 9 but has an opening 18, and the brake shoe 3 is seated with its opening 18 on the pin 17 of the inner shaft 1.

As shown on FIGS. 2A, 2B, 2C 2D and 2E, a second embodiment of this invention is an inner shaft 1 on which a sleeve 2 is rotationally seated. In the sleeve 2 there is rotationally seated an inner roller 4, and between the sleeve 2 and the inner roller 4 there is an annular slot 5 filled with a braking layer 26 formed of a high viscosity medium. The inner roller 4 contains a formed driver 6. In the sleeve 2, between the inner roller 4 and the inner shaft1 there is a brake shoe 3 seated with its pin 9 in opening 7 of the inner shaft 1, and also having a driver 11 which co-operates with the driver 6 of the inner roller 4.

Alternatively, the inner shaft 1 has no opening 7 but has a pin 17, brake shoe 3 has no pin 9 but has an opening 18 and the brake shoe 3 is seated with is opening 18 on the roller's 1 pin 17, similar to what is shown in FIG. 1C.

Figure 3A:
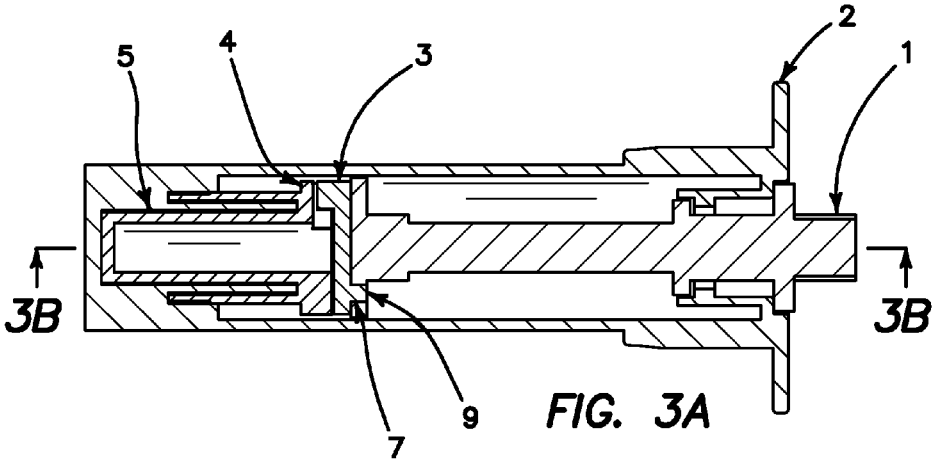
FIG. 3A is a cross section along the lines 1A-1A of FIG. 1 (in other words a longitudinal cross section) showing a third embodiment of this invention.
Figure 3B:
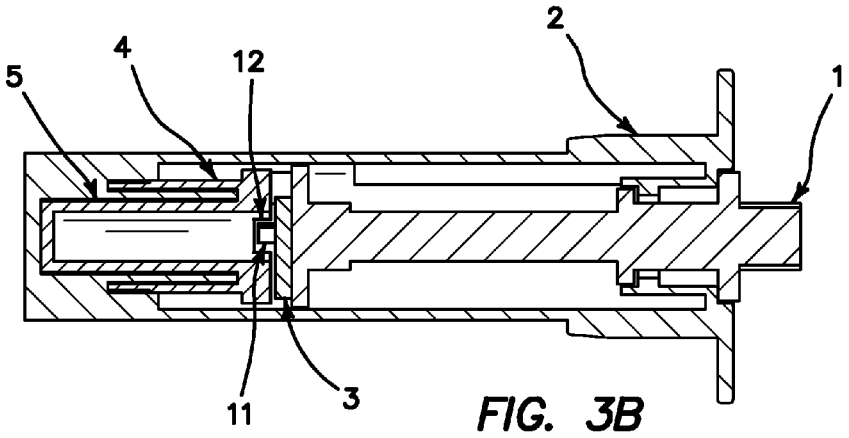
FIG. 3B is a cross section along the lines 3B-3B of FIG. 3A; in other words a longitudinal cross section at 90 degrees from the plane of cross section shown in FIG. 3A.

As shown on FIGS. 3A and 3B, a third embodiment is made up of an inner shaft 1 on which a sleeve 2 is rotationally seated. In the sleeve 2 there is rotationally seated an inner roller 4, and between the sleeve 2 and the inner roller 4 there is an annular slot 5 filled with braking layer 26 formed from high viscosity medium. The inner roller 4 contains a formed relief 12 and in the sleeve 2, between the inner roller 4 and the inner shaft 1 there is a brake shoe 3 seated with its pin 9 in the opening 7 of the inner shaft 1, having a driver 11 which co-operates with the relief 12 of the inner roller 4.

Alternatively, the inner shaft 1 has no opening 7 but has a pin 17, the brake shoe 3 has an opening 18 and the brake shoe 3 is seated with its opening 18 on the pin 17 of the inner shaft 1, similar to what is shown in FIG. 1C.

Figure 4:
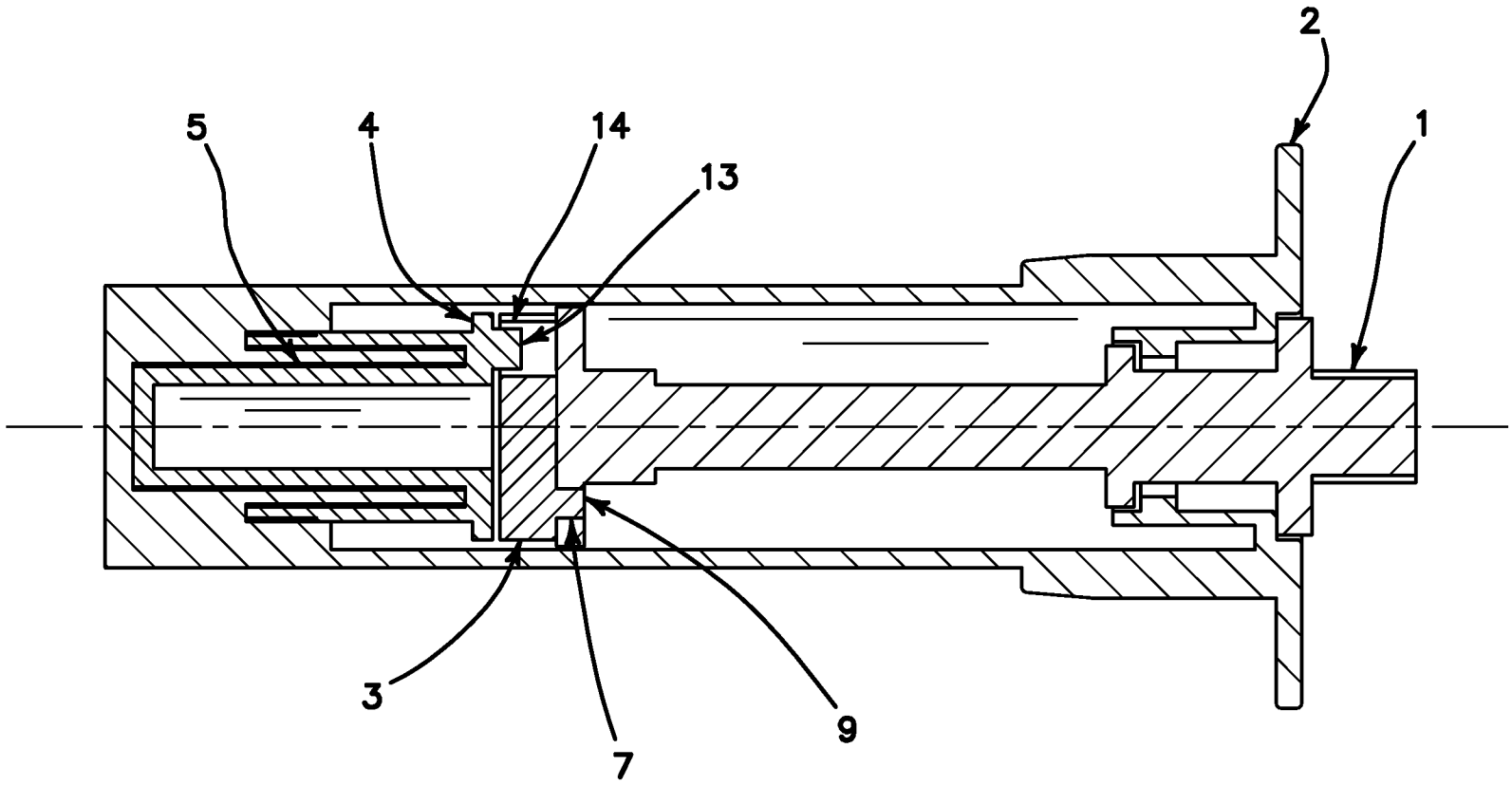
FIG. 4 is a cross section along the lines 1A-1A of FIG. 1 (in other words a longitudinal cross section) showing a fourth embodiment of this invention.
Figure 4A:
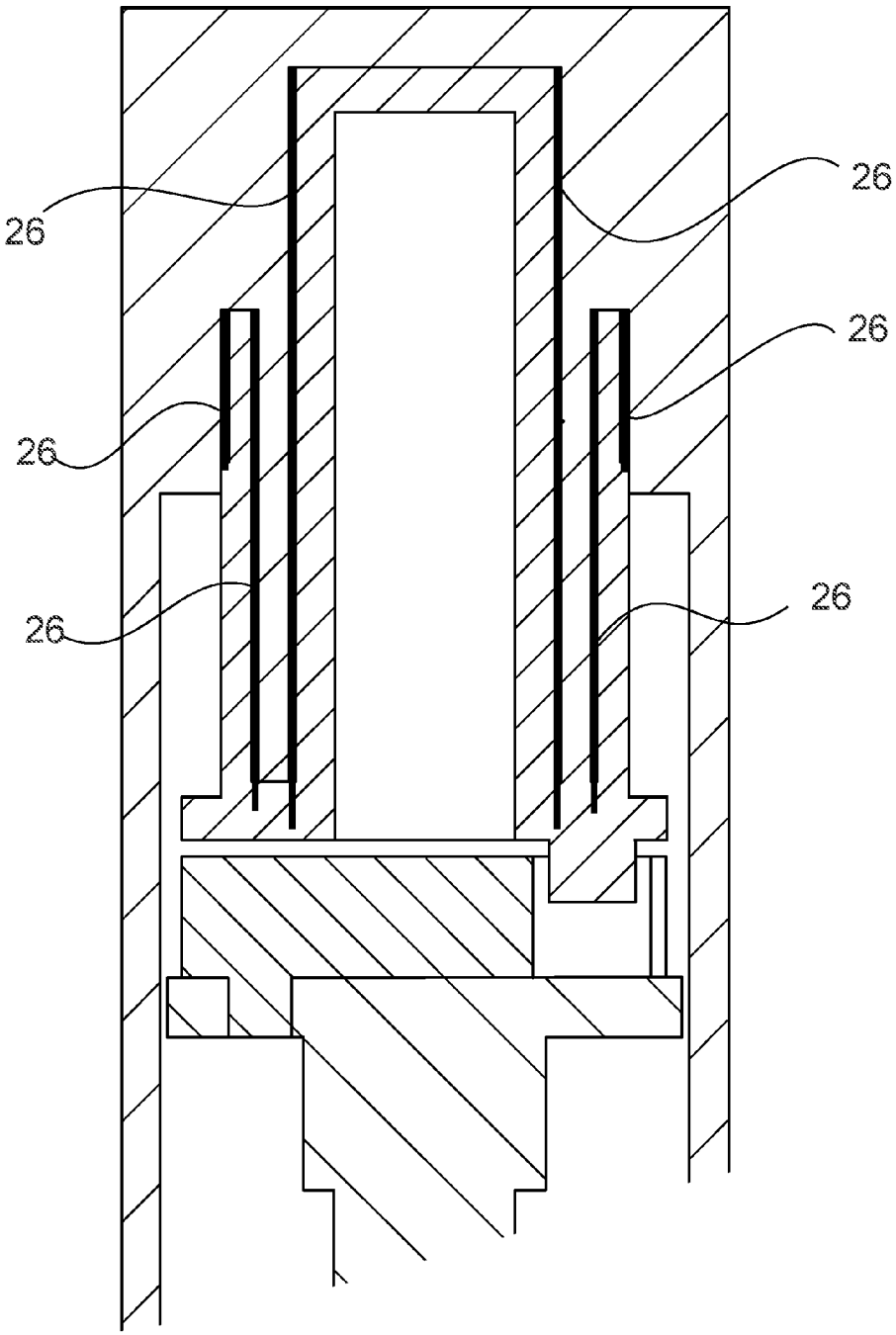
FIG. 4A is an enlarged, partial cross section of FIG. 4.

As shown on FIGS. 4 and 4A, a fourth embodiment of this invention is made up of an inner shaft 1 on which a sleeve 2 is rotationally seated. In the sleeve 2 there is rotationally seated an inner roller 4, and between the sleeve 2 and the inner roller 4 there is an annular slot 5 filled with braking layer 26 formed from high viscosity medium. The inner roller 4 has a pin 13 and in the sleeve 2, between the inner roller 4 and the inner shaft 1 there is a brake shoe 3 seated with its pin 9 in the opening 7 of inner shaft 1, having an opening 14 in which pin 13 of the inner roller 4 is inserted.

Alternatively, the inner shaft 1 has a pin 17, the brake shoe 3 has an opening 18, and the brake shoe 3 is seated with its opening 18 on the pin 17 of the inner shaft 1, similar to what is shown in FIG. 1C.

Figure 5A:
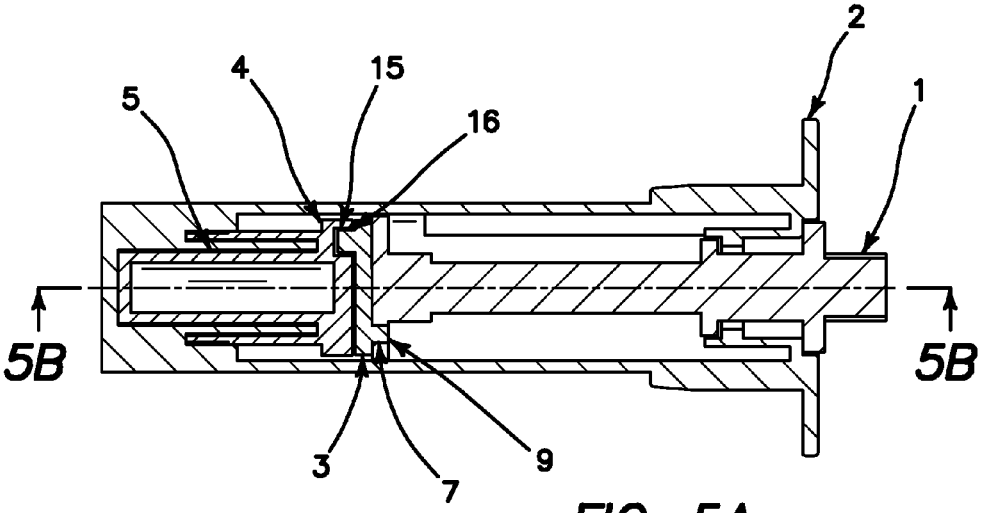
FIG. 5A is a cross section along the lines 1A-1A of FIG. 1 (in other words a longitudinal cross section) showing a fifth embodiment of this invention.
Figure 5B:
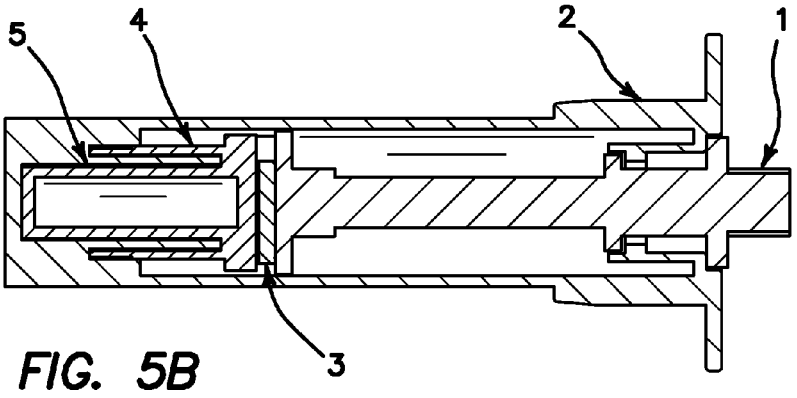
FIG. 5B is a cross section along the lines 5B-5B of FIG. 5A; in other words a longitudinal cross section at 90 degrees from the plane of cross section shown in FIG. 5A.
Figure 5C:
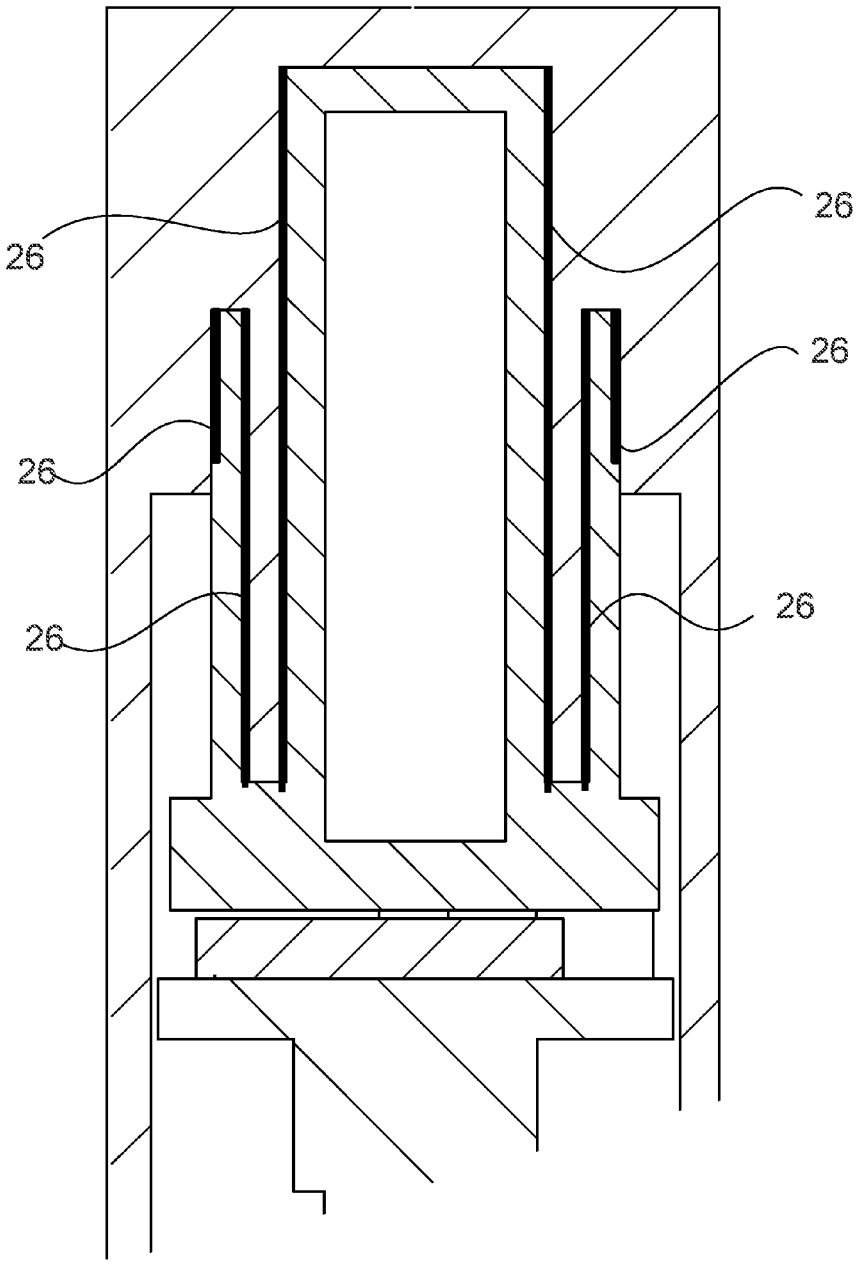
FIG. 5C is an enlarged, partial cross section of FIG. 5B.

As shown on FIGS. 5A 5B and 5C, a fifth embodiment is made up of an inner shaft 1 on which a sleeve 2 is rotationally seated. In the sleeve 2 there is rotationally seated an inner roller 4, and between the sleeve 2 and the roller 4 there is an annular slot 5 filled with braking layer 26 formed from high viscosity medium. The inner roller 4 contains an opening 15 and in the sleeve 2, between the inner roller 4 and the inner shaft 1 there is a brake shoe 3 seated with its pin 9 in the opening 7 of the inner shaft 1, having a pin 16 which co-operates with the opening 15 of the inner roller 4.

Figure 6A:
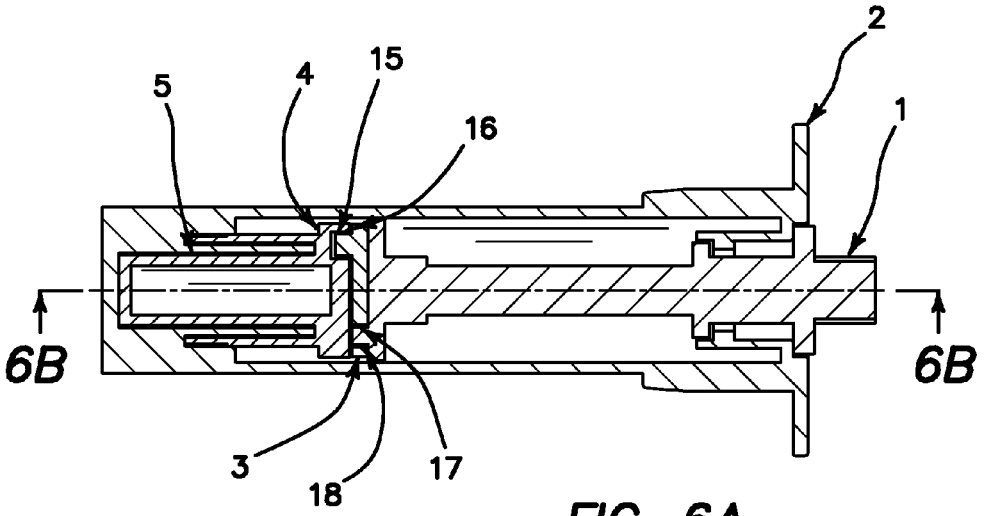
FIG. 6A is a cross section along the lines 1A-1A of FIG. 1 (in other words a longitudinal cross section) showing a first variation of the fifth embodiment of this invention.
Figure 6B:
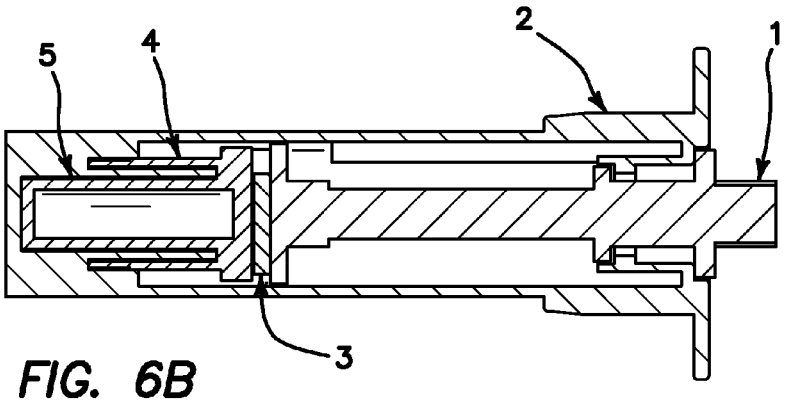
FIG. 6B is a cross section along the lines 6B-6B of FIG. 6A; in other words a longitudinal cross section at 90 degrees from the plane of cross section shown in FIG. 6A.
Figure 6C:
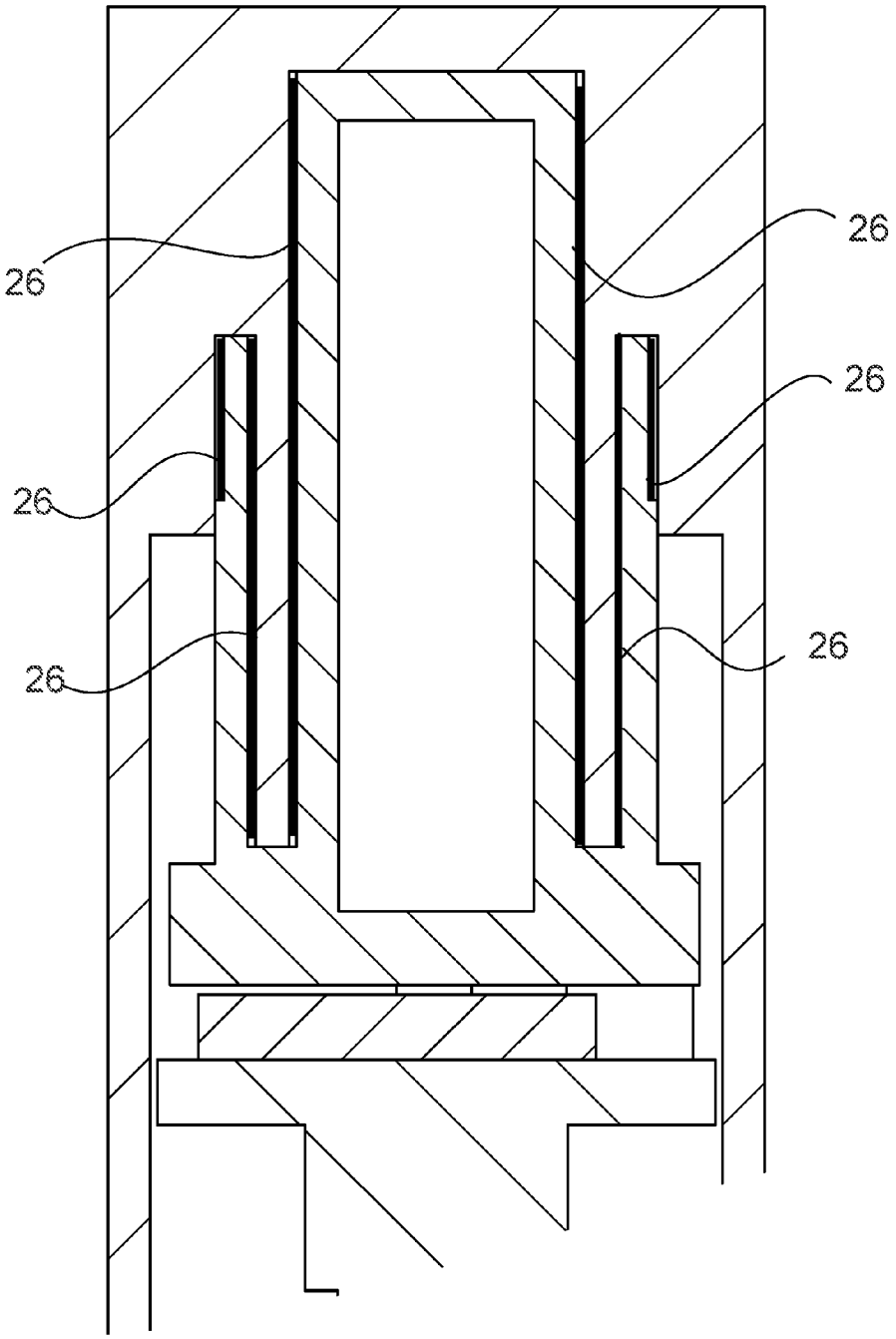
FIG. 6C is an enlarged, partial cross section of FIG. 6B.

Alternatively, as shown on FIGS. 6A and 6B, the inner shaft 1 has no opening 7 but has a pin 17, the brake shoe 3 has no pin 9 but has an opening 18 and the brake shoe 3 is seated with its opening 18 on the roller's 1 pin 17.

Figure 7A:
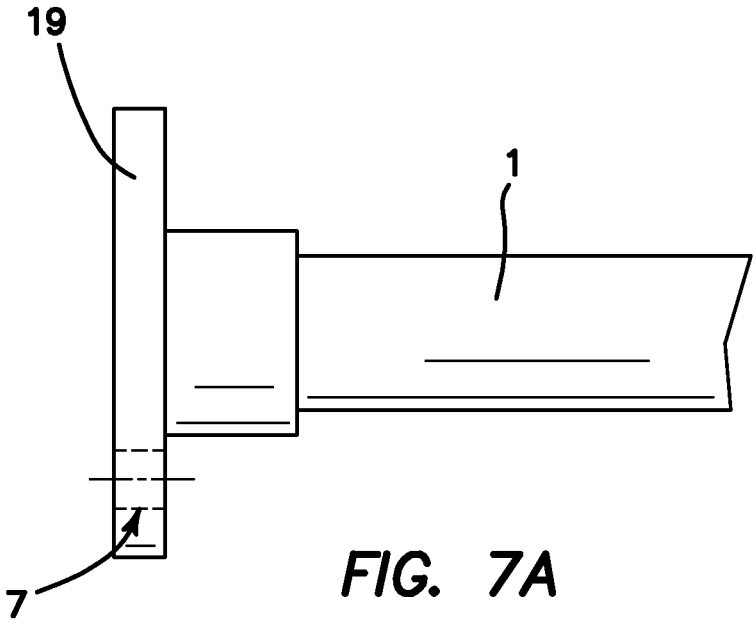
FIG. 7A is a detail of the end of the inner shaft.
Figure 7B:
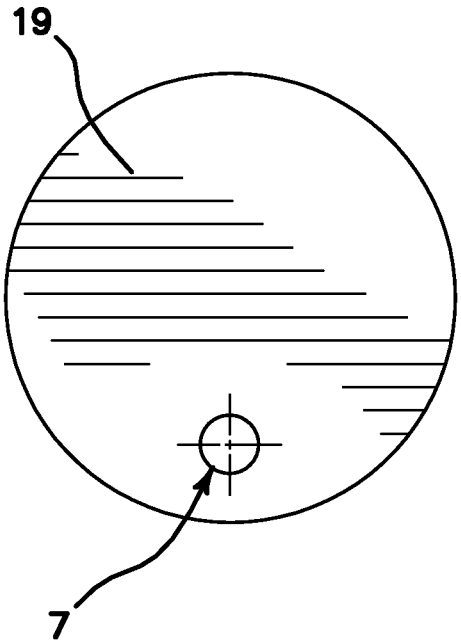
FIG. 7B is an end view of the inner shaft.

FIGS. 7A and 7B show further details of construction for the inner shaft 1.

Figure 8A:
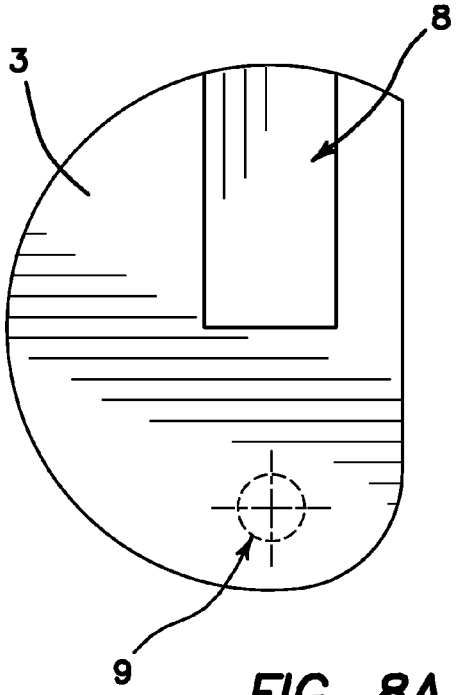
FIG. 8A is a view from one end of the brake shoe.
Figure 8B:
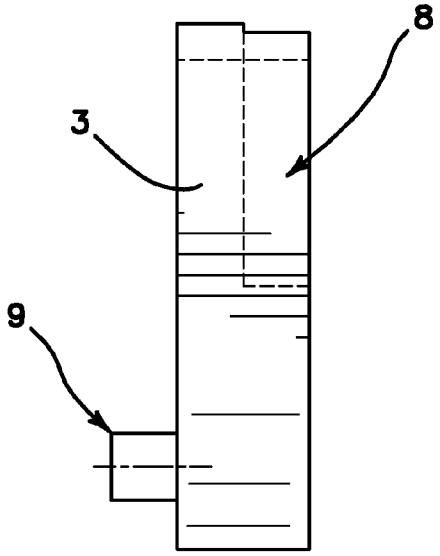
FIG. 8B is a view from one side of the brake shoe.
Figure 8C:
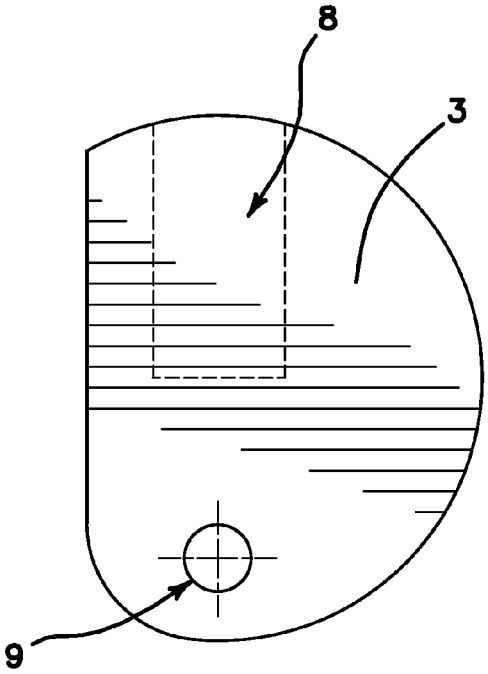
FIG. 8C is a view from the other end of the brake shoe.

FIGS. 8A, 8B and 8C show further details of construction of the brake shoe 3.

Figure 9A:
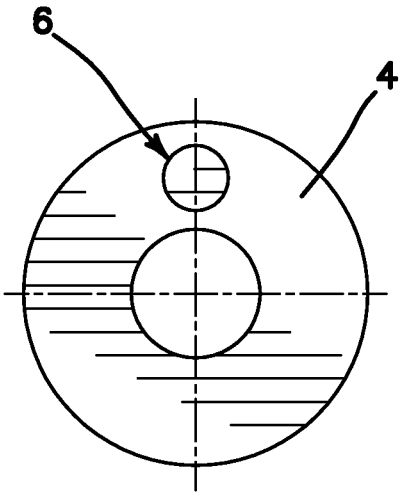
FIG. 9A is a view from the inner end of the inner roller.
Figure 9B:
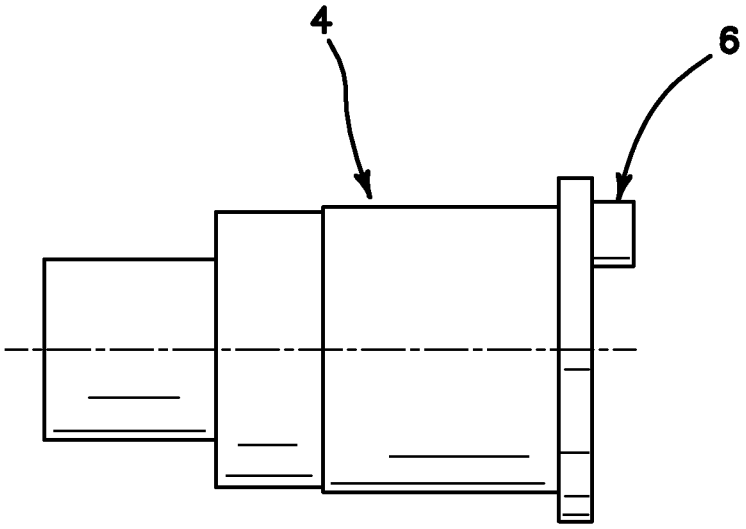
FIG. 9B is a side view of the inner roller.

FIGS. 9A and 9B show further details of construction of the inner roller 4.

Figure 10:
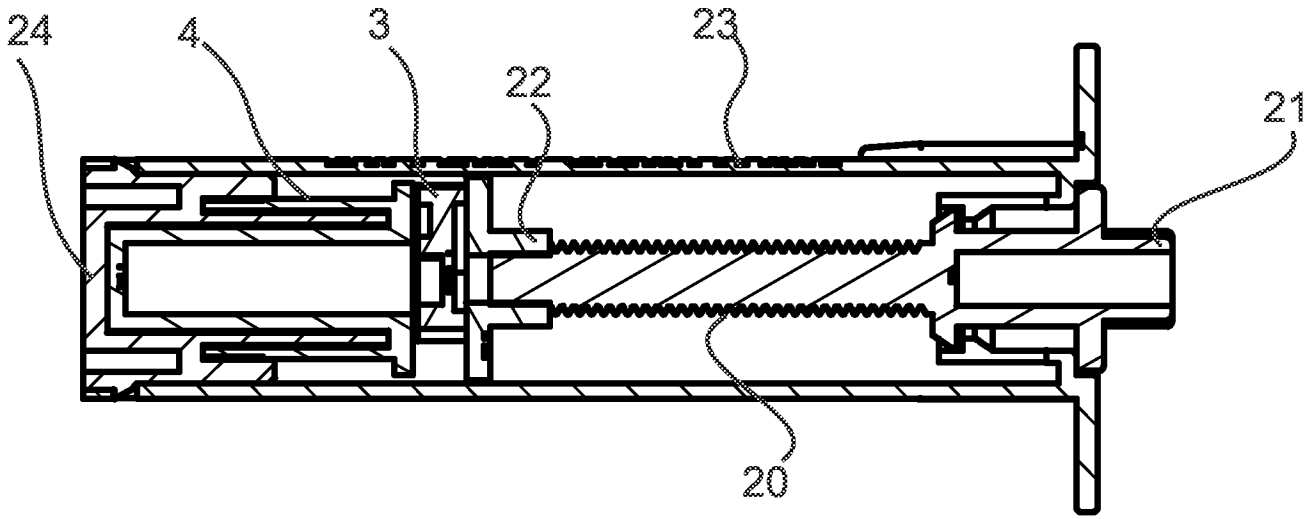
FIG. 10 is a cross sectional view of showing preferred construction of the instant invention.
Figure 11:
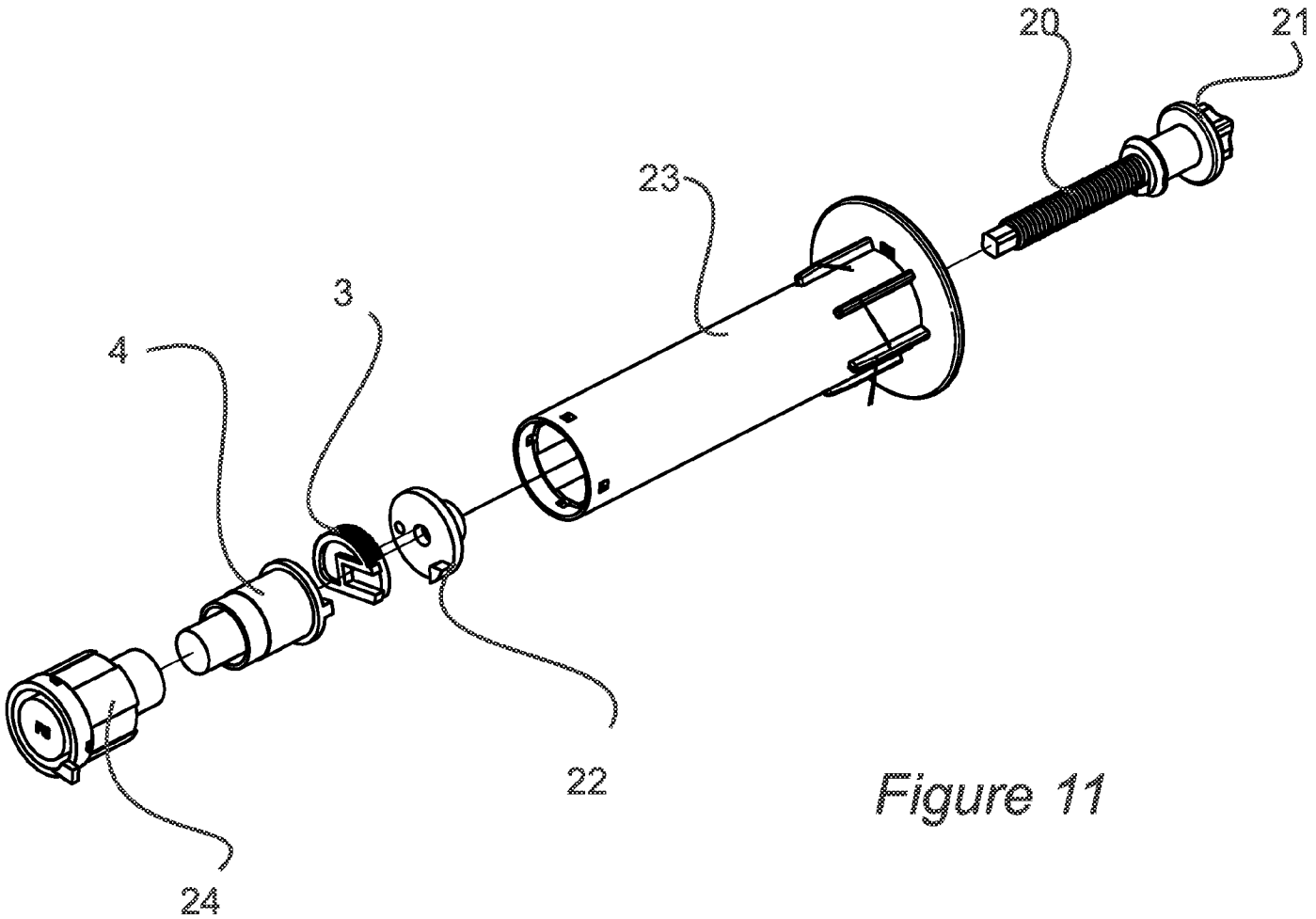
FIG. 11 is an exploded view of the preferred construction of the instant invention.

FIGS. 10 and 11 show the preferred construction of the instant invention. To facilitate fabrication and assembly the inner shaft 1 is constructed of two pieces, an inner end 21 and an index plate 22, joined together; and the sleeve 2 is likewise constructed of two pieces, an inner end 23 and an end cap, joined together.

In each embodiment a torsion spring is mounted inside the winding roller with one end immovably fixed to a roller blind holder that is fixed to a wall or a ceiling and with the other end to a winding roller of the roller blind. The mechanism is immovably fixed to a winding roller with a sleeve 2 and with its inner shaft 1 it is immovably fixed to a roller blind holder that is fixed to a wall or a ceiling. The spring is mounted with some preliminary torsion depending on the size and weight of roller blind and desired winding speed. The greater the torsion in the spring, the greater the winding speed. When the roller blind is pulled down by hand, torsion increases. When it is desired to roll up the blind, spring tension makes the roller 1 rotate thus winding up the blind.

After installing the roller blind to a wall or ceiling the blind can be unwound to a desired length by pulling the bottom edge of the blind. As the blind is pulled down torsion in the spring increases. After the blind is pulled to desired length the bottom edge gets released and, thanks to a ratchet mechanism, which is not a subject of this application, the blind remains unwound. To make the roller blind wind up again the lower edge is gently pulled down and let free. The ratchet mechanism releases the roller allowing it to wind up. Thanks to controlling mechanism of this invention, the roller blind wind up evenly until it reaches the upper position or is pulled once again downwards. Without the controlling mechanism constituting this invention, roller blinds would wind up at a very high, uncontrolled speed which might damage the mechanism and the roller blinds themselves.

The high viscosity medium is non-volatile, non-toxic, and has an average viscosity of 6000 to 26000 mPa·s over a wide temperature range. The principle of its action is as follows.

As shown on FIGS. 4 and 4A, sleeve 2 is seated inside the winding roller pipe. Winding up roller blinds by the torsion spring mounted inside the winding roller through the sleeve 2 and the braking layer 26 formed of high viscosity medium, the roller 4 rotates the brake shoe 3 seated with the pin 9 in the opening 7 of the roller 1 until contact between the side surface of the brake shoe and the inner surface of the sleeve 2 is reached. After contact with the brake shoe and the sleeve, the roller 4 presses the brakes shoe 3 down to the surface of the sleeve 2, thereby increasing the friction between the sleeve 2 and the brake shoe 3 which reduces the winding speed of the roller blinds. With the increase of winding speed of the roller blinds the rotating speed of the sleeve 2 increases, thus increasing the force transmitted through the braking layer 26 and the roller 4 on the brake shoe 3 and thus the roller blinds release. Reducing the speed lowers the power transferred to the brake shoe 3 and thus increasing winding speed of the roller blinds. The solution applying only braking layer 26 between the inner roller 4 and the sleeve 2 does not ensure satisfactory results because of decrease of the acting braking power generated by the braking layer 26. This is also the case when the temperature increases. Application of the brake shoe 3 eliminates effect of reducing the force generated by the braking layer 26, which allows the use of the mechanism at different temperatures and for all types of roller blinds with the torsion spring, regardless of their weight.

The following reference numbers are used on FIGS. 1 through 9B:

1 inner shaft
2 sleeve
3 brake shoe
4 inner roller
5 annular slot
6 formed driver
7 opening
8 relief
9 pin
11 driver
12 formed relief
15 opening
16 pin
17 pin
18 opening
19 end flange of inner shaft
20 threads
21 inner end of inner shaft
22 index plate of inner shaft
23 inner end of sleeve
24 end cap of sleeve
26 braking layer In the instant invention the speed of the roller shade is transferred directly to the sleeve 2. The sleeve 2 rotates the shaft 4 by means of a high viscosity substance between the sleeve 2 and the shaft 4. The shaft 4, as a result of the force of rotation of the sleeve 2, pushes the jaw 3 which is pressed against the inner surface of the sleeve 2, causing the deceleration. Jaw 3 is mounted in the opening in inner shaft 1, which is fixedly secured by the brackets of roller shade fixed to the wall or ceiling, and thus cannot turn. Increased roller shade speed generates a larger force on the shaft 4, and thus a greater braking force.

In the instant invention there are no planetary gears or sprockets and the jaw does not rotate. In the Mase embodiment the jaw must rotate with respect to the axis of rotation of roller shade otherwise it does not produce a braking force. And then, if the weights stop moving there is no braking force.

Moreover, in the instant invention, there is a layer of high viscosity substance which is crucial. Mase does not include a high viscosity substance.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A mechanism for controlling the rotation of a roller blind winding roller comprising:

a) an inner shaft (1);

b) a sleeve (2) rotationally seated on said inner shaft (1);

c) an inner roller (4) rotationally seated in said sleeve (2); said inner roller (4) including a formed driver (6) in said sleeve (2), between said inner roller (4) and said inner shaft (1);

d) a braking layer (26) filling an annular slot (5) between said sleeve (2) and said inner roller (4); and e) a brake shoe (3) between said inner shaft (1) and inner roller (4) having a relief (8) in which said driver (6) is seated.

2. A mechanism according to claim 1 in which said inner shaft (1) has an opening and said brake shoe (3) has a pin (9) seated in said opening (7).

3. A mechanism according to claim 1 in which said brake shoe (3) has an opening (18) and said inner shaft (1) has a pin (17) seated in said opening (18).

* * * * *